US006705428B2

(12) United States Patent
Kudernatsch

(10) Patent No.: US 6,705,428 B2
(45) Date of Patent: Mar. 16, 2004

(54) EXHAUST GAS SYSTEM WITH HELMHOLTZ RESONATOR

(75) Inventor: Günter Kudernatsch, Döttingen (CH)

(73) Assignee: ABB Turbo Systems AG, Baden (CH)

( * ) Notice: Subject to any disclaimer, the term of this patent is extended or adjusted under 35 U.S.C. 154(b) by 0 days.

(21) Appl. No.: 09/991,967

(22) Filed: Nov. 26, 2001

(65) Prior Publication Data

US 2002/0108810 A1 Aug. 15, 2002

(30) Foreign Application Priority Data

Dec. 8, 2000 (CH) ..... 2000 2400/00

(51) Int. Cl.[7] ..... E04F 17/04
(52) U.S. Cl. ..... 181/224; 181/226
(58) Field of Search ..... 84/224, 223, 226, 84/229

(56) References Cited

U.S. PATENT DOCUMENTS

| | | | | |
|---|---|---|---|---|
| 2,940,537 A | | 6/1960 | Smith et al. | |
| 3,688,865 A | | 9/1972 | Smith | |
| 3,709,319 A | | 1/1973 | Lawyer et al. | |
| 3,738,448 A | | 6/1973 | Ver et al. | |
| 4,106,587 A | | 8/1978 | Nash et al. | |
| 4,371,054 A | | 2/1983 | Wirt | |
| 4,645,032 A | | 2/1987 | Ross et al. | |
| 5,162,620 A | | 11/1992 | Ross et al. | |
| 5,276,291 A | | 1/1994 | Norris | |
| 5,644,918 A | | 7/1997 | Dean et al. | |
| 5,801,344 A | * | 9/1998 | Herold | 181/265 |
| 6,009,705 A | * | 1/2000 | Arnott et al. | 123/184.57 |
| 6,082,487 A | * | 7/2000 | Angelo et al. | 181/256 |

FOREIGN PATENT DOCUMENTS

| | | |
|---|---|---|
| DE | 2235829 | 2/1973 |
| DE | 2 240 709 | 4/1973 |
| DE | 4009072 | 9/1991 |
| DE | 4330129 A1 | 3/1995 |
| DE | 44 14 232 | 10/1995 |
| DE | 4419604 | 12/1995 |
| DE | 196 12 987 | 9/1996 |
| DE | 0892216 A1 | 1/1999 |
| EP | 0576717 A1 | 1/1994 |
| EP | 0 723 123 | 7/1996 |
| EP | 0911510 A2 | 4/1999 |
| EP | 0974788 A1 | 1/2000 |
| FR | 2 378 176 | 8/1978 |
| WO | WO 89/08909 | 9/1989 |

OTHER PUBLICATIONS

"Active Control of Low Frequency Turbine Exhaust Noise", B. E. Walker, et al., Noise–Con 2000, Newport Beach, CA, Dec. 3–5, 2000.

"Combustion Turbine Exhaust Systems—Low Frequency Noise Reduction", G. Kudernatsch.

* cited by examiner

*Primary Examiner*—Kimberly Lockett
(74) *Attorney, Agent, or Firm*—Burns, Doane, Swecker & Mathis, L.L.P.

(57) ABSTRACT

A Helmholtz resonator (24, 24', 24", 24*a*), which is screened in an acoustically transparent manner from the flow (S) by means of an absorption noise suppressor (36) is located on the flow duct (16) in order to suppress the low frequencies in an exhaust gas system (10) for industrial gas turbines with an exhaust gas conduit (12) and a chimney (14) which is connected to it, which together form a continuous flow duct (16).

14 Claims, 2 Drawing Sheets

EXHAUST GAS SYSTEM WITH HELMHOLTZ RESONATOR

FIELD OF THE INVENTION

The invention relates to an exhaust gas system for industrial gas turbines with an exhaust gas conduit and a chimney connected to it, as described in the preamble to claim 1. Residential zones and installations which are operated by gas turbines, such as combined heat and power stations, are becoming increasingly close together. In order to keep the noise annoyance to the population at a low level, noise emission restrictions have become more and more severe in recent years. In many places, restrictions on low-frequency noise have been introduced in addition to the existing restrictions on high and medium frequencies. The noise emission from a gas turbine installation principally takes place via its exhaust gas system. The occurrence of the low-frequency noise, which is difficult to deal with, has many causes and may be attributed inter alia to pulsations in the combustion space.

BACKGROUND OF THE INVENTION

So that restrictions on low-frequency noise emissions can be met, absorption noise suppressors have been installed in the exhaust gas system of gas turbine installations, as is mentioned for example in DE-A1-44 19 604 and DE-A1-40 09 072. This is intended to reduce the low-frequency noise at the location at which its radiation into the surroundings takes place. Whereas, however, noise in the high and medium frequency ranges can be relatively successfully absorbed with absorption noise suppressors, low-frequency noise is difficult to deal with because conventional noise suppressors only exhibit a slight noise suppression effect at low frequencies. In order to permit reduction in low-frequency noise, it is therefore necessary to install large absorption noise suppressors with suppression mats of up to 800 mm thickness in the exhaust gas system of the installation. This increases the space requirements of the exhaust gas installation, reduces its power in some circumstances because of the pressure drop in the system and is, in addition, very complicated with respect to assembly and maintenance. In consequence, the exhaust gas system becomes very expensive.

SUMMARY OF THE INVENTION

The object of the invention is therefore to create an exhaust gas system of the type mentioned at the beginning in which low-frequency noise emissions are efficiently reduced without the power of the installation being essentially impaired and which, in addition, is simple and economical with respect to assembly and maintenance. This object is achieved by means of an exhaust gas system with the features of claim 1. In an exhaust gas system for industrial gas turbines, an exhaust gas conduit and a chimney connected to it together form a continuous flow duct. A Helmholtz resonator is acoustically coupled on the flow duct in the exhaust gas system. The Helmholtz resonator is precisely tuned to the low frequency which has to be suppressed. For this purpose, it demands less space than an absorption noise suppressor. The assembly of a Helmholtz resonator is very simple and, at large flow velocity, its useful life is much higher than that of absorption noise suppressors. In addition, the employment of Helmholtz resonators does not cause any decrease in the power of the installation. For these reasons, the exhaust gas system can be more easily assembled and maintained and the overall installation can be operated more economically.

If the inlet opening of the Helmholtz resonator is located in the region of the pressure maximum of an acoustic mode in the exhaust gas system, its efficiency is at a maximum.

It is very advantageous to locate the Helmholtz resonator in the transition region between the exhaust gas duct and the chimney because, as a rule, there are hardly any space problems in this area. It is particularly favorable to provide the Helmholtz resonator on the chimney rear wall, which bounds the exhaust gas duct in the flow direction, because this permits particularly simple assembly.

In a preferred embodiment, the dimensions of the exhaust gas duct and the chimney are selected in such a way that a pressure maximum of the acoustic mode occurs in the transition region between the exhaust gas duct and the chimney. In this way, the Heimholtz resonator can be very simply assembled, as described above, and is in addition extremely efficient.

Thermal insulation of the Helmholtz resonator from the outside ensures an approximately constant temperature of the Helmholtz resonator and, therefore, frequency stability of its absorption properties.

If the Helmholtz resonator has a throat which can be adjusted in its length and/or its cross section, the Helmholtz resonator can be better adjusted to the frequencies to be absorbed.

In a further preferred embodiment, the Helmholtz resonator has an adjustable volume. This again provides a simple possibility for matching to the frequencies to be absorbed. The adjustable volume can be very simply realized if the height of the side walls is arranged to be adjustable by means of a displaceable base.

The Helmholtz resonator can be matched particularly simply to the frequency to be absorbed if its temperature is adjustable. The temperature adjustment capability can, for example, be simply realized by attaching heating elements to the outer walls of the Helmholtz resonator. Another low-cost possibility consists in designing the Helmholtz resonator so that medium can flow around it in such a way that, for the purpose of temperature regulation, either hot exhaust gas is branched from the exhaust gas system and guided around the outer walls of the Helmholtz resonator or cold air flows around the latter.

In a further preferred embodiment, the Helmholtz resonator is screened in an acoustically transparent manner from the flow in the flow duct. This permits improved noise absorption by the Helmholtz resonator. Such screening can be very simply and expediently realized by means of an absorption noise suppressor located between the inlet opening of the Helmholtz resonator and the flow.

It is particularly advantageous to use an absorption noise suppressor which has the following approximate construction: A first perforated cover is part of a wall bounding the flow duct. A flow-resistant fabric and a layer of absorption material, which is located on the side of the perforated cover facing away from the flow duct, adjoins this first perforated cover. A second perforated cover follows this layer of absorption material on the side facing away from the flow duct. The absorption noise suppressor is laterally enclosed by side walls. Such an absorption noise suppressor can accept loads satisfactorily when bounding a flow duct with high flow velocities.

If a hollow space is arranged between the absorption noise suppressor and the inlet opening of the Helmholtz resonator, this has a positive effect on the vibration behavior of the Helmholtz resonator and therefore on its absorption capability.

It is very advantageous to provide a plurality of Helmholtz resonators in the exhaust gas system. These can then be located at different locations in the exhaust gas system, for example where respective maxima of the sonic modes occur. They can also be tuned to different low frequencies and, in this way, contribute to an even more effective reduction in the low-frequency noise. For this purpose, they can be located at different locations in the exhaust gas system or also close together. In order to ensure good noise absorption, however, the Helmholtz resonators should be separated from one another in a gas-tight manner.

Other preferred embodiments are the subject matter of further sub-claims.

BRIEF DESCRIPTION OF THE DRAWINGS

The subject matter is explained in more detail below using preferred embodiment examples, which are represented in the attached drawings. In these, and purely diagrammatically.

Figure 1:
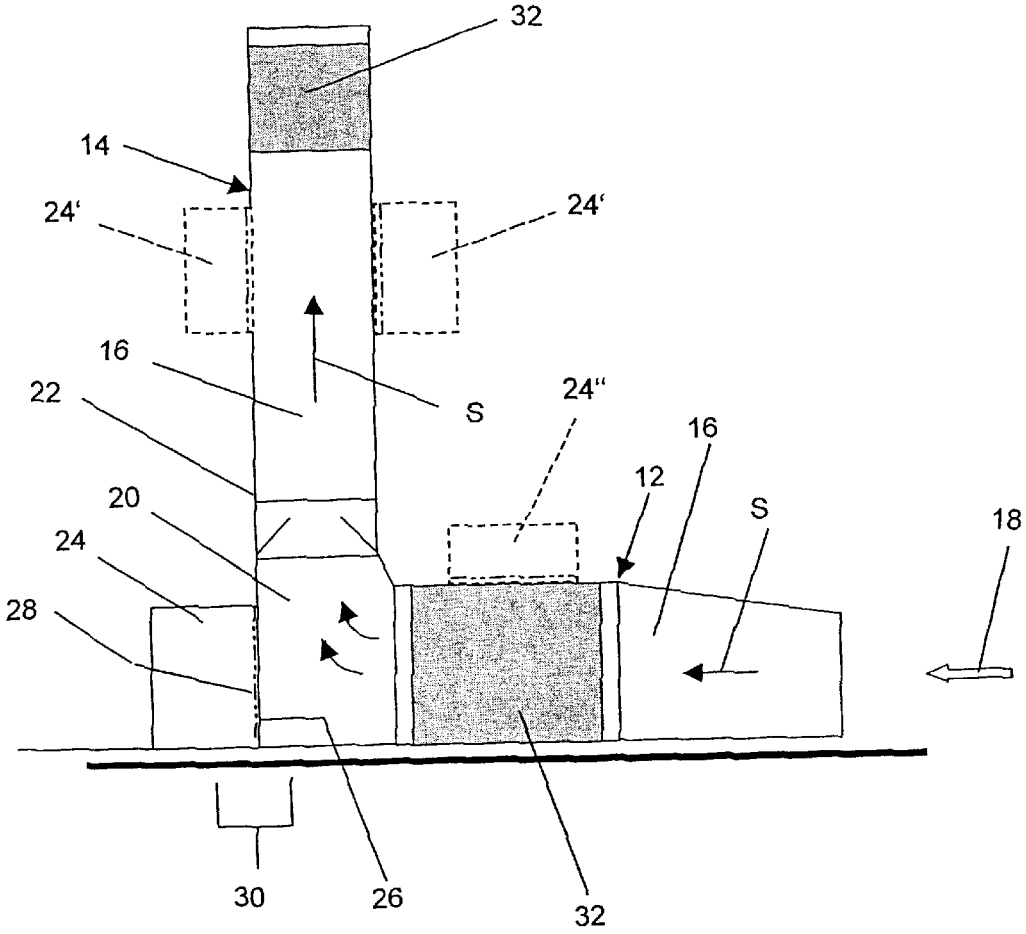
FIG. 1 shows an exhaust gas system according to the invention with Helmholtz resonator.

The designations used in the drawings and their significance are listed in summarized fashion in the list of designations. Fundamentally, the same parts are provided with the same designations in the figures. The embodiments described represent an example of the subject matter of the invention and have no limiting effect.

DETAILED DESCRIPTION OF THE INVENTION

FIG. 1 shows a sketch of an exhaust gas system 10 for a gas turbine installation (not shown) with an exhaust gas duct 12 and a chimney 14. Exhaust gas duct 12 and chimney 14 together form a flow duct 16. The flow direction of the exhaust gas 18 in the flow duct 16 is designated by arrows S. In a transition region 20 between exhaust gas duct 12 and chimney 14, the exhaust gas duct 12 is bounded in its flow direction S by a rear wall 22 of the chimney 14. In the transition region 20, a Helmholtz resonator 24 is located on the rear wall 22 of the chimney 14. The Helmholtz resonator 24 is screened from the flow in the flow duct 16 by a perforated cover 26, which forms a part of the rear wall 22 of the chimney 14, and by an acoustically transparent fabric 28 arranged behind the perforated cover 26 viewed from the flow duct 16.

The exhaust gas duct 12 and the chimney 14 are dimensioned in such a way that a pressure maximum of a sonic mode is located in the transition region 20 or in the inlet region 30 of the Helmholtz resonator 24. The Helmholtz resonator 24 is thermally insulated from the outside so that it takes up an approximately constant temperature during operation. In the exhaust gas system 10, absorption noise suppressors 32 are located in a known manner in the exhaust gas system 10, in addition to the Helmholtz resonator 24, in order to absorb noise in the high and medium frequency ranges.

As is indicated by dashed lines in FIG. 1, it is also possible to locate the Helmholtz resonator 24 at other positions in the exhaust gas system 10 or even to locate a plurality of Helmholtz resonators 24, 24', 24", . . . at various positions in the exhaust gas system 10. In order to achieve a good noise absorption efficiency, the Helmholtz resonator or Helmholtz resonators 24, 24', 24", . . . should be located in the exhaust gas system 10 where a pressure maximum of a sonic mode is located.

Figure 2:
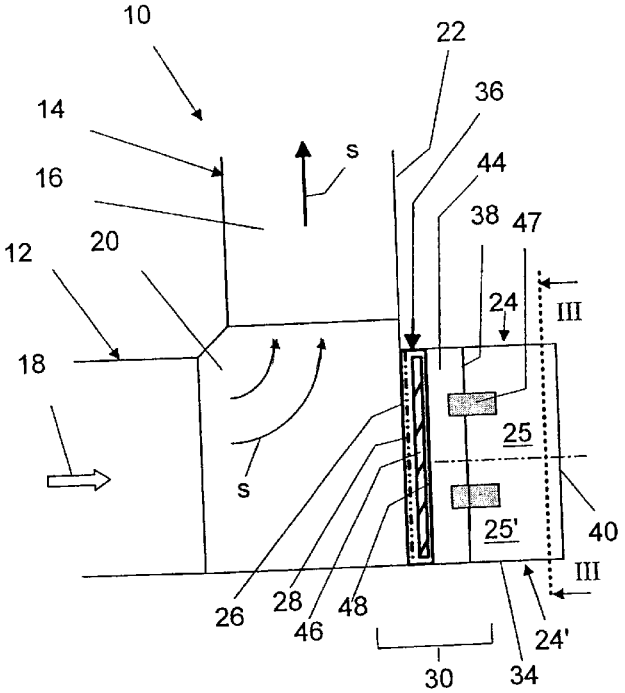
FIG. 2 shows, in a diagrammatic section along the longitudinal axis of the flow duct, a part of an exhaust gas system according to the invention with Helmholtz resonators arranged beside one another.
Figure 3:
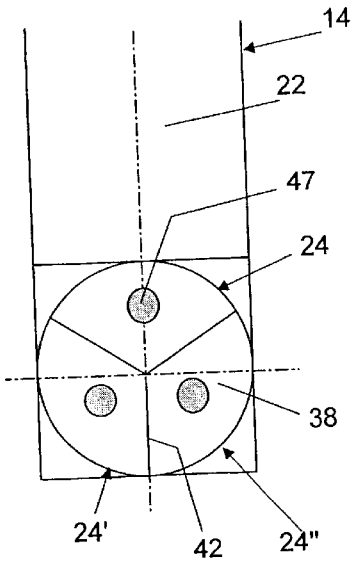
FIG. 3 shows a view along the section line III—III in FIG. 2 of the Helmholtz resonators from FIG. 2 arranged beside one another.

FIGS. 2 and 3 show, in various views, a part of an exhaust gas system 10 in which three Helmholtz resonators 24, 24', 24" are located beside one another in the transition region 20 between exhaust gas duct 12 and chimney 14 on the rear wall 22 of the chimney 14. The dimensions of the exhaust gas duct 12 and the chimney 14 are in turn designed in such a way that the pressure maximum of a sonic mode is located in the transition region 20 or in the inlet region 30 of the Helmholtz resonators 24, 24', 24". The three Helmholtz resonators 24, 24', 24" are configured in a cylindrical hollow body 34. The hollow cylinder 34 is screened from the flow duct 16 by an upstream absorption noise suppressor 36. An intermediate wall 38, which together with the absorption noise suppressor 36 encloses an intermediate space 44, is arranged in the hollow cylinder 34 at a distance from this absorption noise suppressor 36. On the side opposite to the intermediate wall 38, the hollow cylinder 34 is closed in a gas-tight manner relative to the outside by a base 40. The whole of the hollow cylinder 34 and also the base 40 are thermally insulated from the outside so that, during operation, the hollow cylinder 34 approximately adopts the temperature which is present in the flow duct 16.

The absorption noise suppressor 36 has, essentially, the usual construction. The absorption noise suppressor 36 is bounded, relative to the flow duct 16, by a perforated cover 26, which forms a part of the rear wall 22 of the chimney 14. Behind the perforated cover 26 is a flow-resistant and wear-resistant fabric 28, for example a metal fabric, but one which is acoustically transparent. Following in layer construction on the fabric 28, there is a layer of absorption material 46, which can be constructed in one or a plurality of layers to match the frequency range to be absorbed. The material and the thickness of the absorption material 46 are respectively determined by the requirement. Finally, a further perforated cover 48 is located towards the intermediate space 44. The shell of the hollow cylinder 34 also forms the side walls for the absorption noise suppressor 36.

The hollow space of the hollow cylinder 34 remaining between the intermediate wall 38 and the base 40 is subdivided into three sectors by means of walls 42, which sectors form the volumes 25, 25', 25" of the three Helmholtz resonators 24, 24', 24". The walls 42 close off the Helmholtz resonators 24, 24', 24" in a gas-tight manner relative to one another. Each Helmholtz resonator 24, 24', 24" is acoustically connected, by means of a tubular throat 47 which is led through the intermediate wall 38, to the intermediate space 44 located between the upstream absorption noise suppressor 36 and the intermediate wall 38. Low-frequency noise which is not absorbed by the absorption noise suppressor 36 is fed into the intermediate space 44 and on into the three Helmholtz resonators 24, 24', 24". The number and shape of the Helmholtz resonators 24, 24', 24" shown here can be altered as required. A Helmholtz resonator 24 with two, three, four or also more resonators 24, 24', 24", . . . can therefore be located beside one another. The shape can also be arbitrarily varied. A plurality of cylinders can be located beside one another instead of the cylinder sectors or also, however, arbitrary polygonal shapes. In addition, one or a plurality of Helmholtz resonators 24, 24', 24", . . . can also be located beside one another at other positions in the exhaust gas system 10.

In a particular embodiment, the three Helmholtz resonators 24, 24', 24" are adjusted by means of throats 47, which can be adapted in length and/or in cross section, and by means of an adjustable volume 25, 25', 25" to slightly different low frequencies, which preferably also differ from the frequency which is suppressed in the intermediate space 44. The low-frequency noise can, in this way, be reduced highly efficiently. The principle of an adaptable Helmholtz resonator 24*a* is shown in section in FIG. 4. As may be seen from FIG. 4, the throat 47*a* has two tubes 50, 52 which are pushed one into the other. Arbitrary other cross-sectional shapes can also, however, be selected. The outer tube 50 with the larger diameter is firmly anchored in the intermediate wall 30. It can, for example, be welded to the intermediate wall 30. On its inner surface, the outer tube 50 has, in each of its two end regions, protrusions 54 which extend radially inward and are located on circular disks. A seal 56, which surrounds in a gas-tight manner the inner tube 52 with the somewhat smaller diameter, is located between the protrusions 54. The inner tube 52 is concentrically supported in the outer tube 50 and can be displaced against the resistance of the seal 56. The inner tube 52 has ends 53, which are bent radially outward and which, when brought into contact with the protrusions 54, prevent the inner tube 52 from being extracted too far from the outer tube 50. The throat 47*a* of the Helmholtz resonator 24*a* can be displaced in its length by displacing the inner tube 52 in the outer tube 50. The throat diameter can, for example, be made adjustable by configuring the throat with a polygonal cross section and by configuring the side walls of the polygon so that they can be moved relative to one another by means of linkages.

The volume 25*a* of the Helmholtz resonator 24*a* can be adjusted by means of the side walls 58, which can be adjusted in height. The height of the side walls 58 can be altered with the aid of a displaceable base 60. The displaceable base 60 has a pot-shaped configuration and comprises a base plate 62 and base walls 64 protruding approximately at right angles from the base plate 62, which base walls 64 laterally surround the side walls 58 of the Helmholtz resonator 24*a*. At their ends 66 opposite to the base plate 62, the base walls 64 are bent radially inward. A collar 68 extending radially inward is provided on the base walls 64 at a distance from the bent-up ends 66. A base seal 70, which surrounds the side walls 58 of the Helmholtz resonator 24*a* in a gas-tight manner, is located between the collar 68 and the bent-up ends 66 of the base walls 64. At their end facing towards the base 60, the side walls 58 have radially outwardly bent edges 72, which can be brought into contact with the collar 68 and in this way prevent the base being withdrawn from the side walls 58 of the Helmholtz resonator 24*a*. The volume 25*a* of the Helmholtz resonator 24*a* can therefore be adjusted during the displacement of the base 60 from contact between the base plate 62 and the rims 72 of the side walls 58 to contact between the rims 72 of the side walls 58 with the collar 68 of the base wall 64. The Helmholtz resonator 24*a* can therefore be adjusted precisely to the frequency to be suppressed by means of the adjustable throat 47*a* and the adjustable volume 25*a*.

Figure 4:
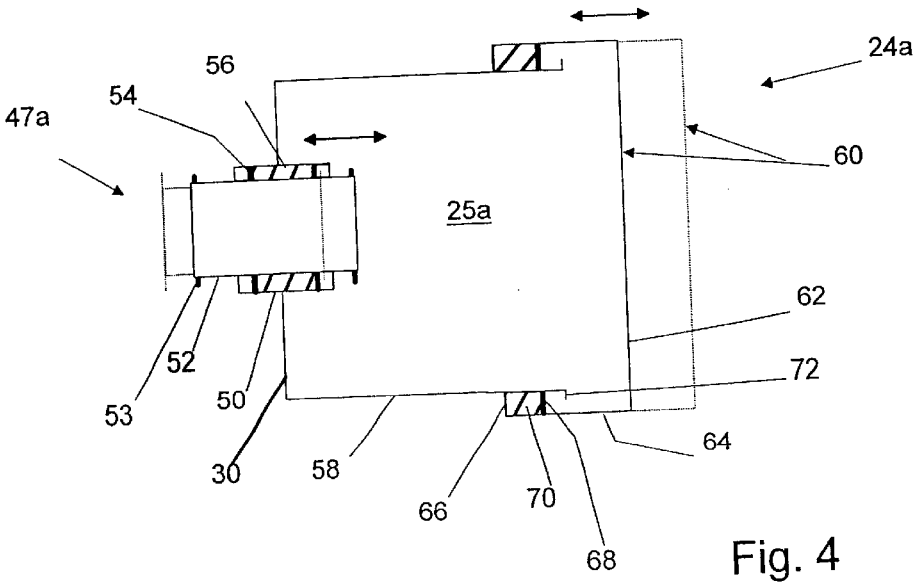
FIG. 4 shows a diagrammatic section through a Helmholtz resonator with throat adjustable in length and adjustable volume.

For greater clarity, the distance between the two tubes 54, 56 and between the base walls 64 and the side walls 58 of the Helmholtz resonator 24*a* are shown exaggeratedly large in FIG. 4.

LIST OF DESIGNATIONS

10 Exhaust gas system
12 Exhaust gas duct
14 Chimney
16 Flow duct
18 Exhaust gas
20 Transition region
22 Rear wall
24, 24', 24" Helmholtz resonator
25, 25', 25" Volume
26 Perforated cover
28 Fabric
30 Inlet region
32 Absorption noise suppressor
34 Hollow cylinder
36 Upstream absorption noise suppressor
38 Intermediate wall
40 Base
42 Walls
44 Intermediate space
46 Absorption material
48 Further perforated cover
50 Outer tube
52 Inner tube
54 Protrusion
56 Seal
58 Side walls
60 Displaceable base
62 Base plate
64 Base wall
66 Bent-up ends
68 Collar
70 Base seal
72 Bent-up rims

What is claimed is:

1. An exhaust gas system for industrial gas turbines with an exhaust gas conduit and a chimney connected to it, which together form a continuous flow duct, and having a device for noise reduction, wherein a Helmholtz resonator is provided for suppressing the low frequencies of the noise Helmholtz resonator being located outside of said flow duct and having an inlet region arranged in the region of a pressure maximum of an acoustic mode.

2. The exhaust gas system as claimed in claim 1, wherein the dimensions of the exhaust gas duct and the chimney are selected in such a way that the pressure maximum of the acoustic mode occurs in the transition region between exhaust gas duct and chimney.

3. The exhaust gas system as claimed in claim 1, wherein the Helmholtz resonator is located in the transition region between exhaust gas duct and chimney and, in fact, preferably on the chimney rear wall, which bounds the exhaust gas duct in the flow direction.

4. The exhaust gas system as claimed in claim 1, wherein the Helmholtz resonator is thermally insulated from the outside.

5. The exhaust gas system as claimed in claim 1, wherein the Helmholtz resonator has a throat which can be adjusted in its length.

6. The exhaust gas system as claimed in claim 1, wherein the temperature of the Helmholtz resonator can be adjusted.

7. The exhaust gas system as claimed in claim 1, wherein the inlet region of the Helmholtz resonator is screened in an acoustically transparent manner from the flow in the flow duct and, in fact, preferably by means of an absorption noise suppressor located between the throat of the Helmholtz resonator and the flow.

8. The exhaust gas system as claimed in claim 7, wherein the absorption noise suppressor has a first perforated cover, which preferably forms a part of a wall bounding the flow duct, and in that it comprises a flow-resistant fabric located on the side of the perforated cover facing away from the flow duct, a layer of absorption material adjacent to the fabric, a second perforated cover opposite to the first perforated cover and side walls.

9. The exhaust gas system as claimed in claim 7, wherein an intermediate space is located between the absorption noise suppressor and the throat of the Helmholtz resonator.

10. The exhaust gas system as claimed in claim 1, wherein a plurality of Helmholtz resonators are provided which are preferably tuned to different frequencies or modes.

11. The exhaust gas system as claimed in claim 10, wherein the Helmholtz resonators are separated from one another in a gas-tight manner.

12. The exhaust gas system as claimed in claim 1, wherein the Helmholtz resonator has a throat which can be adjusted in its cross section.

13. The exhaust gas system as claimed in claim 1, wherein the Helmholtz resonator has a volume which is adjustable.

14. The exhaust gas system as claimed in claim 1, wherein the Helmholtz resonator has a volume which is adjustable by the height of its side walls being adjusted by means of a displaceable base.

* * * * *